United States Patent [19]

Brust

[11] Patent Number: 4,542,087

[45] Date of Patent: Sep. 17, 1985

[54] USE OF REFLECTING AGENT IN YELLOW DYE IMAGE-PROVIDING MATERIAL LAYER

[75] Inventor: David P. Brust, Rochester, N.Y.

[73] Assignee: Eastman Kodak Company, Rochester, N.Y.

[21] Appl. No.: 646,541

[22] Filed: Sep. 4, 1984

[51] Int. Cl.[4] ..... G03C 5/54; G03C 1/40; G03C 1/84

[52] U.S. Cl. ..... 430/220; 430/212; 430/505; 430/507

[58] Field of Search ..... 430/220, 507, 212, 505

[56] References Cited

U.S. PATENT DOCUMENTS 3,177,078 4/1965 Bockly et al. ..... 430/507

FOREIGN PATENT DOCUMENTS 0668592 8/1963 Canada ..... 430/220
66341 12/1982 European Pat. Off. ..... 430/220

OTHER PUBLICATIONS

"Photographic Processes and Products", *Research Disclosure* No. 15162, 11/1976, pp. 75–84.

*Primary Examiner*—Richard L. Schilling
*Attorney, Agent, or Firm*—Harold E. Cole

[57] ABSTRACT

Photographic elements and diffusion transfer assemblages are described wherein a sufficient amount of a reflecting agent, such as titanium dioxide, is employed in the yellow dye image-providing material layer so that the layer is an effective yellow filter layer for good color reproduction.

22 Claims, No Drawings

USE OF REFLECTING AGENT IN YELLOW DYE IMAGE-PROVIDING MATERIAL LAYER

This invention relates to photography, and more particularly to color diffusion transfer photography wherein the layer containing the yellow dye image-providing material also contains a sufficient amount of a reflecting agent so that the layer is an effective yellow filter layer. The use of a separate yellow filter layer is thereby avoided.

Various formats for color, integral transfer elements are described in the prior art, such as U.S. Pat. Nos. 3,415,644; 3,415,645; 3,415,646; 3,647,437; 3,635,707; 3,756,815, and Canadian Pat. Nos. 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in propor-tion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

In a three-color photographic element described above, each silver halide emulsion layer will have associated therewith a dye image-providing material which possesses a predominant spectral absorption within the region of the visible spectrum to which said silver halide emulsion is sensitive, i.e., the blue-sensitive silver halide emulsion layer will normally have a yellow dye image-providing material associated therewith, the green-sensitive silver halide emulsion layer will normally have a magenta dye image-providing material associated therewith and the red-sensitive silver halide emulsion layer will normally have a cyan dye image-providing material associated therewith. The dye image-providing material associated with each silver halide emulsion layer may be contained either in the silver halide emulsion layer or in a layer contiguous to the silver halide emulsion layer, i.e., the dye image-providing material can be coated in a separate layer underneath the silver halide emulsion layer with respect to the exposure direction.

Virtually all camera-speed color photographic systems use the same basic layer structure described above. The top-most layer is usually sensitized to blue light. Beneath this layer, a yellow filter layer is usually required because the sensitivity of the lower layers, extended into the red and green region by sensitizing dyes, still retain their native blue sensitivity. Such a yellow filter layer will absorb blue light so that only red and green light will reach the two lower emulsion layers and maintain proper color reproduction. If the red and green-sensitive layers receive a blue light exposure, color contamination will result.

Two materials have commonly been used for the yellow filter layer: (1) yellow colored organic dyes and (2) Carey-Lea Silver (CLS) dispersed colloidal silver. However, there are problems associated with the use of both of these materials.

Yellow filter dyes may diffuse uncontrollably and some are costly because of their complex structure.

While Carey-Lea silver is easy to prepare and use, in image transfer elements, it is normally not recoverable and is an additional source of lost and wasted silver. Carey-Lea silver may also act to promote physical development and thus cause low $D_{max}$, notably magenta.

In image transfer systems employing preformed dyes, such as redox dye-releasers or dye developers, it might be thought that the yellow dye image-providing material could serve a dual role as yellow image dye source and filter dye. In practice, however, the yellow dye image-providing material would have to be coated at a relatively high level, well above that amount required for image formation, in order to obtain the required protection of the lower layers. Such a high level could cause sensitometric problems and from an economic viewpoint, an expensive filter dye is merely being replaced by an even more expensive dye image-providing material.

European Patent Application No. 66,341 relates to the use of a spacer layer between a silver halide emulsion layer and an adjacent layer of image-providing material, the spacer layer comprising a light-reflecting pigment in a dispersion of inert polymeric particles. This light-reflecting layer increases the effective film speed as a result of the reflection of light back to the silver halide. There is no disclosure in this patent application, however, of the use of light-reflecting pigments to eliminate a separate yellow filter layer.

In accordance with the invention, a photo-sensitive element is provided which comprises a support having thereon a red-sensitive silver halide emulsion layer having a dye image-providing material associated therewith, a green-sensitive silver halide emulsion layer having a dye image-providing material associated therewith, and a blue-sensitive silver halide emulsion layer having a yellow dye image-providing material associated therewith, and wherein the layer containing the yellow dye image-providing material contains a sufficient amount of a reflecting agent so that the layer is an effective yellow filter layer for good color reproduction.

In a preferred embodiment of the invention, the red-sensitive silver halide emulsion layer has a cyan dye image-providing material associated therewith and the green-sensitive silver halide emulsion layer has a magenta dye image-providing material associated therewith. In "false-sensitized" elements, the red-sensitive silver halide emulsion layer may have a magenta dye image-providing material associated therewith, the green-sensitive silver halide emulsion layer may have a cyan dye image-providing material associated therewith, etc.

Use of the invention decreases the blue light transmission to the underlying red- and green-sensitive layers. As a result, the use of a separate yellow filter layer is eliminated and no additional dye image-providing material is required to be coated, with a resultant significant cost savings.

The addition of the reflecting agent to the yellow dye image-providing material layer increases the absorption of the incident radiation by multiple internal reflection. As a result, blue light is effectively absorbed, but there is little effect on green or red light being transmitted to the lower light-sensitive layers. No significant green or red speed losses have been observed. In addition, sharpness and access time (time for first viewing a diffusion transfer image) are also unaffected. The fact that sharpness was unaffected was especially surprising since reflecting agents are light-scattering.

Any reflecting agent may be employed in the invention as long as it provides the desired function as described above and is photographically inert. In general, a good reflecting agent would: (1) be white or colorless in the visible region of the spectrum, (2) have an index of refraction higher than the surrounding medium, (3) have a particle size in the range of about 0.15 to about 0.35μm, and (4) be insoluble in water. Good results can be obtained with barium sulfate, titanium dioxide, barium stearate, alumina, zirconium oxide, zirconium acetyl acetate, sodium zirconium sulfate, kaolin or mica. In a preferred embodiment, titanium dioxide is employed.

The amount of reflecting agent employed can be any amount which is sufficient for the intended purpose of providing, in combination with the yellow dye image-providing material, an effective yellow filter layer for good color reproduction.

Although even the use of a small amount of reflecting agent will provide some benefit, the amount to be employed in a given system depends on many variables. For example, a yellow redox dye-releaser having a very high extinction coefficient would require a relatively small amount of reflecting agent to provide an effective yellow filter layer. Conversely, if a reflecting material having an index of refraction close to that of the surrounding medium is employed, a large amount of that material would be required in order to provide an effective yellow filter layer.

In addition, the amount of reflecting agent which is effective in a given photographic system also depends upon its overall sensitivity. With higher speed photographic elements, there is an even greater need for an effective filter layer. As the effective photographic speed of the system increases, more reflecting agent would be required for the layer to be an effective yellow filter. This would obviously be less expensive than increasing the amount of yellow dye image-providing material, which is much more expensive than the reflecting agent.

The amount of reflecting agent to be employed in the invention which is effective in a given photographic system is thus to be determined in a practical sense. In general, good results have been obtained when the reflecting agent is present at a concentration of at least about 0.01 gram per square meter of coated element. When titanium dioxide is employed as the reflecting agent, good results have been obtained at a concenration of from about 0.1 to about 0.75 gram per square meter of coated element.

Use of this invention will provide the requisite separation between the blue speed of the blue-sensitive layer and the blue speed of the green- and red-sensitive layers to obtain good color reproduction. The exact speed separation required for a given photographic material is determined in a practical sense by a visual comparision of the original subject versus the image obtained. For some materials, a speed separation of at least 0.3 log E is adequate, while for others a speed separation of at least 1.0 log E is needed.

A photographic assemblage in accordance with the invention comprises: (a) a photosensitive element as described above and (b) a dye image-receiving layer.

The photosensitive element in the above-described assemblage can be treated with an alkaline processing composition to effect or initiate development in any manner. A preferred method for applying processing composition is by use of a rupturable container or pod which contains the composition.

In a preferred embodiment of the invention the photographic assemblage comprises:

(a) a photosensitive element as described above;

(b) a transparent cover sheet located over the layer outermost from the support of the photosensitive element;

(c) a dye image-receiving layer located either in the photosensitive element or on the transparent cover sheet; and (d) an alkaline processing composition and means containing same for discharge between the photosensitive element and the transparent cover sheet.

In a preferred embodiment of the invention, the means containing the alkaline processing composition is a rupturable container or pod which is adapted to be positioned during processing of the film unit so that a compressive force applied to the container by pressure-applying members, such as would be found in a camera designed for in-camera processing, will effect a discharge of the container's contents within the film unit. In general, the processing composition employed in this invention contains the developing agent for development, although the composition could also just be an alkaline solution where the developer is incorporated in the photographic element or cover sheet, in which case the alkaline solution serves to activate the incorporated developer.

The dye image-providing material useful in this invention is either positive- or negative-working, and is either initially mobile or immobile in the photographic element during processing with an alkaline composition. Examples of initially mobile, positive-working dye image-providing materials useful in this invention are described in U.S. Pat. Nos. 2,983,606; 3,536,739; 3,705,184; 3,482,972; 2,756,142; 3,880,658 and 3,854,985. Examples of negative-working dye image-providing materials useful in this invention include conventional couplers which react with oxidized aromatic primary amino color developing agents to produce or release a dye such as those described, for example, in U.S. Pat. No. 3,227,550 and Canadian Pat. No. 602,607. In a preferred embodiment of this invention, the dye image-providing material is a ballasted, redox dye-releasing (RDR) compound. Such compounds are well known to those skilled in the art and are, generally speaking, compounds which will react with oxidized or unoxidized developing agent or electron transfer agent to release a dye. Such nondiffusible RDR's include negative-working compounds, as described in U.S. Pat. No. 3,728,113 of Becker et al; U.S. Pat. No. 3,725,062 of Anderson and Lum; U.S. Pat. No. 3,698,897 of Gompf and Lum; U.S. Pat. No. 3,628,952 of Puschel et al; U.S. Pat. Nos. 3,443,939 and 3,443,940 of Bloom et al; U.S. Pat. No. 4,053,312 of Fleckenstein; U.S. Pat. No. 4,076,529 of Fleckenstein et al; U.S. Pat. No. 4,055,428 of Koyama et al; U.S. Pat. No. 4,149,892 of Deguchi et al; U.S. Pat. Nos. 4,198,235 and 4,179,291 of Vetter et al; *Research Disclosure* 15157, November, 1976 and *Research Disclosure* 15654, April, 1977. Such nondiffusible RDR's also include positive-working compounds, as described in U.S. Pat. Nos. 3,980,479; 4,139,379; 4,139,389; 4,199,354, 4,232,107, 4,199,355 and German Pat. No.

2,854,946, the disclosures of which are hereby incorporated by reference.

In a preferred embodiment of the invention, RDR's such as those in the Fleckenstein et al patent referred to above are employed. Such compounds are ballasted sulfonamido compounds which are alkali-cleavable upon oxidation to release a diffusible dye from the nucleus and have the formula:

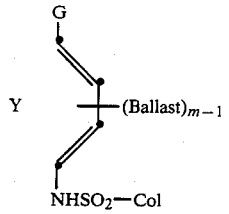

wherein:

(a) Col is a dye or dye precursor moiety;

(b) Ballast is an organic ballasting radical of such molecular size and configuration (e.g., simple organic groups or polymeric groups) as to render the compound nondiffusible in the photosensitive element during development in an alkaline processing composition;

(c) G is OR or NHR$^1$ wherein R is hydrogen or a hydrolyzable moiety and R$^1$ is hydrogen or a substituted or unsubstituted alkyl group of 1 to 22 carbon atoms, such as methyl, ethyl, hydroxyethyl, propyl, butyl, secondary butyl, tertiary butyl, cyclopropyl, 4-chlorobutyl, cyclobutyl, 4-nitroamyl, hexyl, cyclohexyl, octyl, decyl, octadecyl, docosyl, benzyl or phenethyl (when R$^1$ is an alkyl group of greater than 6 carbon atoms, it can serve as a partial or sole Ballast group);

(d) Y represents the atoms necessary to complete a benzene nucleus, a naphthalene nucleus or a 5- to 7-membered heterocyclic ring such as pyrazolone or pyrimidine; and (e) m is a positive integer or 1 to 2 and is 2 when G is OR or when R$^1$ is a hydrogen or an alkyl group of less than 8 carbon atoms.

For further details concerning the above-described sulfonamido compounds and specific examples of same, reference is made to the above-mentioned Fleckenstein et al U.S. Pat. No. 4,076,529.

In another preferred embodiment of the invention, positive-working, nondiffusible RDR's of the type disclosed in U.S. Pat. Nos. 4,139,379 and 4,139,389 are employed. In this embodiment, an immobile compound is employed which as incorporated in a photographic element is incapable of releasing a diffusible dye. However, during photographic processing under alkaline conditions, the compound is capable of accepting at least one electron (i.e., being reduced) and thereafter releases a diffusible dye. These immobile compounds are ballasted electron accepting nucleophilic displacement compounds.

A format for integral negative-receiver photographic elements in which the present invention is useful is disclosed in Canadian Pat. No. 928,559. In this embodiment, the support for the photographic element is transparent and is coated with the image-receiving layer, a substantially opaque, light-reflective layer, and the photosensitive layers described above. A rupturable container, containing an alkaline processing composition including a developing agent and an opacifier, is positioned between the top layer and a transparent cover sheet which has thereon, in sequence, a neutralizing layer, and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photo-sensitive silver halide emulsion is coated on an opaque support and a dye image-receiving layer is located on a separate transparent support superposed over the layer outermost from the opaque support. In addition, this transparent support also contains a neutralizing layer and a timing layer underneath the dye image-receiving layer.

In another embodiment of the invention, the neutralizing layer and timing layer are located underneath the photosensitive layer or layers. In that embodiment, the photosensitive element would comprise a support having thereon, in sequence, a neutralizing layer, a timing layer and the photo-sensitive silver halide emulsion layers having associated therewith dye image-providing materials. The dye image-receiving layer would be provided on transparent cover sheet with the processing composition being applied therebetween.

The concentration of the dye image-providing material that is employed in the various layers of the photosensitive element of the present invention can be varied over a wide range, depending upon the particular compound employed and the results desired. For example, the dye image-providing material coated in a layer at a concentration of 0.1 to 3 g/m$^2$ has been found to be useful. The dye image-providing material is usually dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, catechol compounds, and 3-pyrazolidinone compounds as disclosed in column 16 of U.S. Pat. No. 4,358,527, issued Nov. 9, 1982. A combination of different ETA's, such as those disclosed in U.S. Pat. No. 3,039,869, can also be employed. These ETA's are employed in the liquid processing composition or contained, at least in part, in any layer or layers of the photographic element or film assemblage to be activated by the alkaline processing composition, such as in the silver halide emulsion layers, the dye image-providing material layers, interlayers, image-receiving layer, etc.

In this invention, in which dye image-providing materials can be used which produce diffusible dye images as a function of development, either conventional negative-working or direct-positive silver halide emulsions can be employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted dye image-providing materials. After exposure of the film assemblage or unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye image-providing material compounds and the oxidized form of the compounds then undergoes a base-initiated reaction to release the dyes image-wise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a neutralizing layer in the film unit or image-receiving unit lowers the pH of the film unit or image receiver to stabilize the image.

Internal image silver halide emulsions useful in this invention are described more fully in the November, 1976 edition of *Research Disclosure,* pages 76 through 79, the disclosure of which is hereby incorporated by reference.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Any material is useful as the dye image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November 1976 edition of *Research Disclosure,* the disclosure of which is hereby incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after imbibition. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g, alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. Pat. No. 4,362,806, issued Dec. 7, 1982.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following example is provided to further illustrate the invention.

EXAMPLE (A) A control integral imaging-receiver (IIR) element was prepared by coating the following layers in the order recited on a transparent poly(ethylene terephthalate) film support. Quantities are parenthetically given in grams per square meter, unless otherwise stated.

(1) Image-receiving layer of poly(styrene-co-N-benzyl-N, N-dimethyl-N-vinylbenzylammonium chloride-co-divinylbenzene) (molar ratio 49/49/2) (1.1) and gelatin (1.2);

(2) Image-receiving layer of poly(styrene-co-1-vinylimidazole-co-3-benzyl-1-vinylimidazolium chloride) (50:40:10 mole ratio) (1.6) and gelatin (0.75);

(3) Reflecting layer of titanium dioxide (17) and gelatin (2.6);

(4) Opaque layer of carbon black (0.95) and gelatin (0.65);

(5) Gelatin interlayer (0.54);

(6) Stripping layer of Natrosol® GXR-250 hydroxyethyl cellulose (0.81);

(7) Opaque layer of carbon black (0.95) and gelatin (0.65);

(8) Cyan dye-providing layer of gelatin (0.86) and cyan RDR A (0.35);

(9) Cyan dye-providing layer of gelatin (0.65) and cyan RDR A (0.08);

(10) Red-sensitive, direct-positive silver bromide emulsion (1.1 silver), gelatin (1.2), Nucleating Agent A (45 mg/Ag mole), Nucleating Agent B (1.6 mg/Ag mole), 2-(2-octadecyl)-5-sulfohydroquinone potassium salt (0.14) and titanium dioxide (0.81);

(11) Interlayer of gelatin (1.2) and 2,5-di-sec-dodecylhydroquinone (1.2);

(12) Magenta dye-providing layer of magenta RDR B (0.35) and gelatin (0.86);

(13) Magenta dye-providing layer of magenta RDR B (0.08) and gelatin (0.65);

(14) Green-sensitive, direct-positive silver bromide emulsion (0.91 silver), gelatin (0.91), Nucleating Agent A (12.0 mg/Ag mole), Nucleating Agent B (1.1 mg/Ag mole), 2-(2-octadecyl)-5-sulfohydroquinone potassium salt (6 mg/Ag mole) and titanium dioxide (0.22);

(15) Interlayer of green-sensitive, negative silver bromide emulsion (0.065 silver), gelatin (1.2); 2,5-di-sec-dodecylhydroquinone (1.1), and yellow filter dye A (0.13);

(16) Yellow dye-providing layer of yellow RDR C (0.32), yellow RDR D (0.22), gelatin (1.2) and hardener bis(vinylsulfonyl)methane (0.006);

(17) Blue-sensitive, direct-positive silver bromide emulsion (0.92 silver), gelatin (0.91), Nucleating Agent A (36.0 mg/Ag mole), Nucleating Agent B (2.1 mg/Ag mole), 2-(2-octadecyl)-5-sulfohydroquinone potassium salt (6 mg/Ag mole) and t-butylhydroquinone monoacetate (0.016); and

(18) Overcoat layer of gelatin (0.89) and 2,5-di-sec-dodecylhydroquinone (0.10).

The direct-positive emulsions are approximately 1.2$\mu$ monodispersed, octahedral internal image silver bromide emulsions, as described in U.S. Pat. No. 3,923,513.

Cyan RDR A
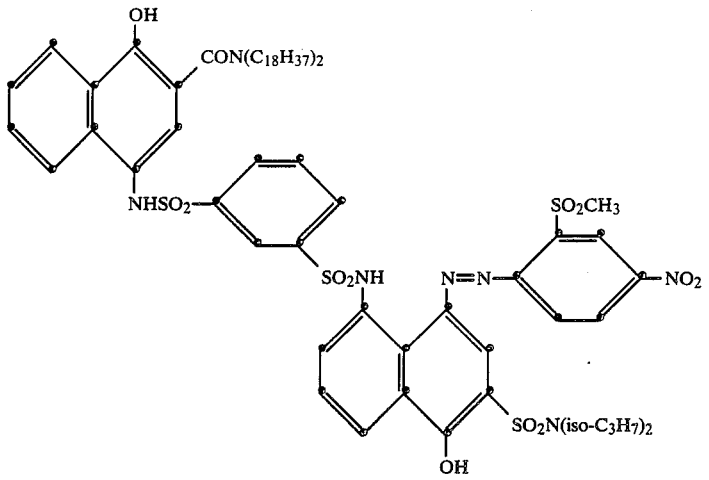
(Dispersed in N-butylacetanilide, RDR/solvent ratio 1:2)
Magenta RDR B
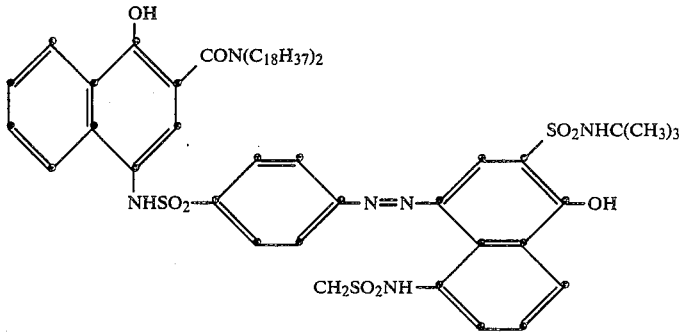
(Dispersed in diethyllauramide, RDR/solvent ratio 1:2)
Yellow RDR C
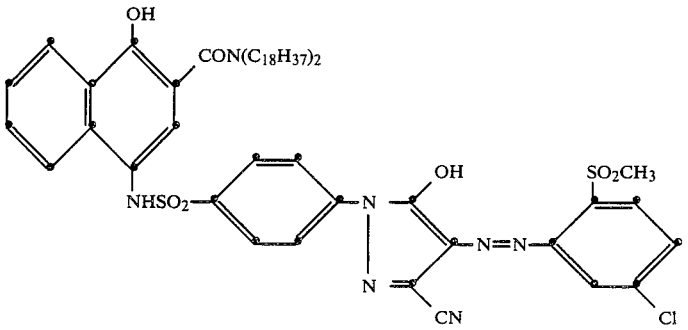
(Dispersed in di-n-butyl phthalate, RDR/solvent ratio 1:2)
Yellow RDR D -continued

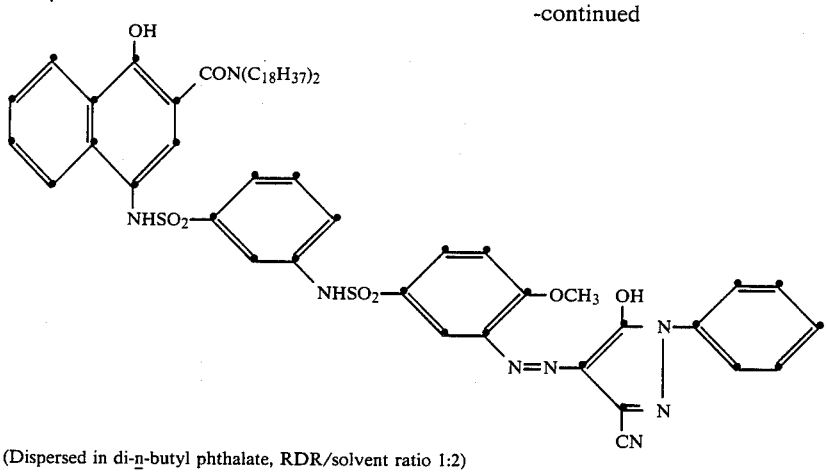

(Dispersed in di-n-butyl phthalate, RDR/solvent ratio 1:2)

Nucleating Agent A

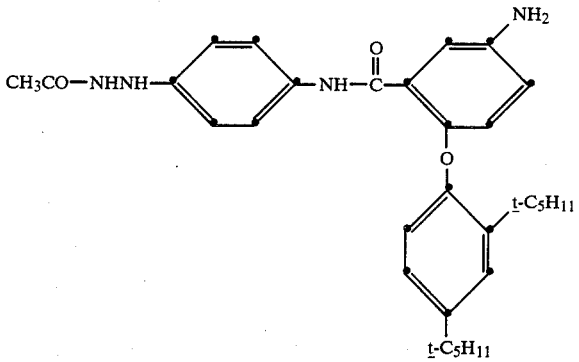

Nucleating Agent B

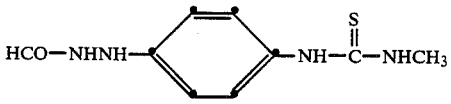

Yellow Filter Dye A

4-{[2,4-bis(1,1-dimethylpropyl)phenoxy]-acetyl}amino-N-{4,5-dihydro-5-[(4-methoxyphenyl)-azo]-5-oxo-1-(2,4,6-trichlorophenyl)-1H-pyrazol-3-yl}-benzamide (B) A control IIR element similar to (A) was prepared except that the yellow filter dye of layer 15 was omitted.

(C) An IIR according to the invention was prepared similar to (B) except that the yellow dye-providing layer 16 contained 0.22 g/m$^2$ of titanium dioxide.

(D) An IIR similar to C) was prepared except that the $TiO_2$ was present at 0.27 g/m$^2$.

(E) An IIR similar to C) was prepared except that the $TiO_2$ was present at 0.38 g/m$^2$.

A cover sheet was prepared by coating the following layers, in the order recited, on a poly(ethylene terephthalate) film support:

(1) a neutralizing layer comprising poly(n-butyl acrylate-co-acrylic acid), (30:70 weight ratio equivalent to 140 meq. acid/m$^2$);

(2) a timing layer comprising 5.4 g/m$^2$ of a 1:1 physical mixture by weight of poly(acrylonitrile-co-vinylidene chloride-co-acrylic acid latex) (weight ratio of 14/80/6) and a carboxy ester lactone formed by cyclization of a vinyl acetate-maleic anhydride copolymer in the presence of 1-butanol to produce a partial butyl ester, ratio of acid/butyl ester 15/85, containing 0.22 g/m$^2$ of t-butylhydroquinone monoacetate, and 0.16 g/m$^2$ of 1-phenyl-5-phthalimidomethylthiotetrazole;

(3) gelatin (3.8 g/m$^2$) hardened with bis(vinylsulfonyl)methyl ether (0.038 g/m$^2$); and (4) heat-sealing layer of poly(acrylonitrile-covinylidene chloride-co-acrylic acid) latex (0.97 g/m$^2$) at a 14:80:6 weight ratio.

A processing composition was prepared as follows:

| | |
|---|---|
| 52.2 g | potassium hydroxide |
| 12 g | 4-methyl-4-hydroxymethyl-1-p-tolyl-3-pyrazolidinone |
| 1.5 g | 1,4-cyclohexanedimethanol |
| 4 g | 5-methylbenzotriazole |
| 1 g | potassium sulfite |
| 6.4 g | Tamol SN ® dispersant |
| 10 g | potassium fluoride |
| 46 g | carboxymethylcellulose |
| 192 g | carbon |
| | water to 1 liter. |

The IIR's prepared above were given a blue separation exposure with a Wratten 98 filter. The exposed IIR's were then processed at room temperature by rupturing a pod containing the viscous processing composition described above between the IIR's and the cover sheet described above, by using a pair of juxtaposed rollers to provide a processing gap of about 100 μm. After a period of not less than ten minutes, the red, green and blue Status A densities were read and the D vs Log E curves were obtained by composite integration of the individual step densities The relative blue speed was measured for both the blue- and green-sensitive layers, assigning a value of 30 for each 0.3 log E increment. The log E separation between the blue and green curves (blue speed separation) was also measured at D=1.0. The following results were obtained:

TABLE 1

| IIR | Contains Yellow Filter Dye | $TiO_2$ in Layer 16 ($g/m^2$) | Blue Separation Exposure: Relative Blue Speed: Blue Layer | Relative Blue Speed: Green Layer | Log E Separation Between Blue and Green Curves |
|---|---|---|---|---|---|
| A (Control) | Yes | None | 172 | 24 | 1.5 |
| B (Control) | No | None | 180 | 83 | 1.0 |
| C | No | 0.22 | 177 | 44 | 1.3 |
| D | No | 0.27 | 177 | 38 | 1.4 |
| E | No | 0.38 | 180 | 31 | 1.5 |

(Control IIR A) containing the yellow filter dye had a good separation between the blue and green curves of 1.5 log E. Prior experience has shown that this will not cause any significant color contamination problem.

(Control IIR B) containing no filter dye gave a blue-green separation of only 1.0 log E. This is less than satisfactory because the higher relative speed of the green layer and resulting lesser separation of blue and green speed would cause color contamination in this particular system.

The three IIR's according to the invention show that as the level of titanium dioxide was increased, the blue speed remained essentially constant, i.e., there was only a negligible blue speed increase due to reflectivity from the pigment in the adjaent layer. The relatie green speed, however, proportionately decreased due to less blue light reaching the green-sensitive emulsion layer. The two higher levels of titanium dioxide gave log E separations approaching and equal to that obtained using the yellow filter dye.

Additional samples of the IIR's prepared above were exposed in a sensitometer through a graduated density test object to yield a full scale image. Neutral scale sensitometry adjusted to a Status A neutral density of 1.0 was obtained to evaluate relative speed (white light), $D_{max}$ and $D_{min}$. Sharpness was evaluated by exposing the IIR to a "knife edge target" and evaluating CMT Acutance. Details of this procedure are found in "An Improved Objective Method for Rating Picture Sharpness-CMT Acutance", R. G. Gendon, *Journal of the SMPTE*, 82, 1009–12 (1973). After exposure, the IIR's were processed as above. The following results were obtained:

TABLE 2

| IIR | Contains Yellow Filter Dye | $TiO_2$ in Layer 16 ($g/m^2$) | $D_{max}$ B | $D_{max}$ G | $D_{min}$ B | $D_{min}$ G | Relative Speed B | Relative Speed G | CMT Accutance B | CMT Accutance G |
|---|---|---|---|---|---|---|---|---|---|---|
| A (Control) | Yes | None | 2.1 | 2.2 | 0.16 | 0.16 | 82 | 76 | 86.5 | 86.5 |
| C | No | 0.22 | 2.0 | 2.2 | 0.16 | 0.17 | 85 | 79 | 86.5 | 86.3 |
| D | No | 0.27 | 2.0 | 2.2 | 0.17 | 0.17 | 85 | 80 | 85.8 | 85.7 |
| E | No | 0.38 | 2.0 | 2.2 | 0.16 | 0.17 | 85 | 78 | 86.2 | 85.7 |

No significant differences in $D_{max}$, $D_{min}$, relative speed and sharpness were observed in comparing the IIR's of the invention with the IIR containing the yellow filter dye. The fact that sharpness was not degraded in coatings containing $TiO_2$, a light-scattering material, was especially significant.

Although this invention has been described with reference to diffusion transfer photography, it would also have application to conventional photography where yellow filter layers are employed to enable the use of less yellow filter material.

The invention has been described in detail with particular reference to preferred embodiments thereof, but it will be understood that variations and modifications can be effected within the spirit and scope of the invention.

What is claimed is:

1. In a photosensitive element comprising a support having thereon a red-sensitive silver halide emulsion layer having a dye image-providing material associated therewith, a green-sensitive silver halide emulsion layer having a dye image-providing material associated therewith, and a blue-sensitive silver halide emulsion layer having a yellow dye image-providing material associated therewith, the improvement wherein the layer containing said yellow dye image-providing material contains a sufficient amount of a reflecting agent so that the layer is an effective yellow filter layer for good color reproduction, said reflecting agent being photographically inert and white or colorless in the visible region of the spectrum.

2. The element of claim 1 wherein the red-sensitive silver halide emulsion layer has a cyan dye image-providing material associated therewith and the green-sensitive silver halide emulsion layer has a magenta dye image-providing material associated therewith.

3. The element of claim 2 wherein said reflecting agent is barium sulfate, titanium dioxide, barium stearate, alumina, zirconium oxide, zirconium acetyl acetate, sodium zirconium sulfate, kaolin or mica.

4. The element of claim 2 wherein said reflecting agent is titanium dioxide.

5. The element of claim 2 wherein said reflecting agent is present at a concentration of at least about 0.01 gram per square meter of coated element.

6. The element of claim 2 wherein each emulsion layer and each dye image-providing material are coated in separate layers.

7. The element of claim 6 wherein each said dye image-providing material is a ballasted sulfonamido compound which is alkali-cleavable upon oxidation to release a diffusible color-providing moiety, said compound having the formula:

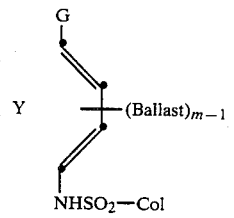

wherein:

(a) Col is a dye or dye precursor moiety;

(b) Ballast is an organic ballasting radical of such molecular size and configuration as to render said compound nondiffusible in said photosensitive element during development in an alkaline processing composition;

(c) G is OR or NHR$^1$ wherein R is hydrogen or a hydrolyzable moiety and R$^1$ is hydrogen or an alkyl group of 1 to 22 carbon atoms;

(d) Y represents the atoms necessary to complete a benzene nucleus, a naphthalene nucleus or a 5- to 7-membered heterocyclic ring; and (e) m is a positive integer of 1 to 2 and is 2 when G is OR or when R$^1$ is hydrogen or an alkyl group of less than 8 carbon atoms.

8. The element of claim 7 wherein said reflecting agent is titanium dioxide which is present at a concentration of from about 0.1 to about 0.75 gram per square meter of coated element.

9. In a photographic assemblage comprising:

(a) a photosensitive element comprising a support having thereon a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith; and (b) a dye image-receiving layer, the improvement wherein the layer containing said yellow dye image-providing material contains a sufficient amount of a reflecting agent so that the layer is an effective yellow filter layer, said reflecting agent being photographically inert and white or colorless in the visible region of the spectrum.

10. The photographic assemblage of claim 9 which also contains an alkaline processing composition and means containing same for discharge within said assemblage.

11. The photographic assemblage of claim 10 wherein said reflecting agent is barium sulfate, titanium dioxide, barium stearate, alumina, zirconium oxide, zirconium acetyl acetate, sodium zirconium sulfate, kaolin or mica.

12. The photographic assemblage of claim 10 wherein said reflecting agent is titanium dioxide which is present at a concentration of from about 0.1 to about 0.75 gram per square meter of coated meter.

13. The photographic assemblage of claim 10 wherein said reflecting agent is present at a concentration of at least about 0.01 gram per square meter of coated element.

14. The photographic assemblage of claim 10 wherein each emulsion layer and each dye image-providing material are coated in separate layers.

15. The photographic assemblage of claim 14 wherein each said dye image-providing material is a ballasted sulfonamido compound which is alkali-cleavable upon oxidation to release a diffusible color-providing moiety, said compound having the formula:

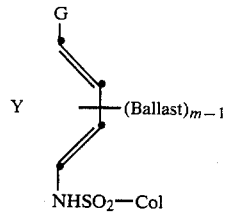

wherein:

(a) Col is a dye or dye precursor moiety;

(b) Ballast is an organic ballasting radical of such molecular size and configuration as to render said compound nondiffusible in said photosensitive element during development in an alkaline processing composition;

(c) G is OR or NHR$^1$ wherein R is hydrogen or a hydrolyzable moiety and R$^1$ is hydrogen or an alkyl group of 1 to 22 carbon atoms;

(d) Y represents the atoms necessary to complete a benzene nucleus, a naphthalene nucleus or a 5- to 7-membered heterocyclic ring; and (e) m is a positive integer of 1 to 2 and is 2 when G is OR or when R$^1$ is hydrogen or an alkyl group of less than 8 carbon atoms.

16. The assemblage of claim 9 wherein:

(a) said dye image-receiving layer is located in said photosensitive element between said support and said silver halide emulsion layer; and (b) said assemblage also includes a transparent cover sheet over the layer outermost from said support.

17. The assemblage of claim 16 wherein said transparent cover sheet is coated with, in sequence, a neutralizing layer and a timing layer.

18. The assemblage of claim 17 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

19. The assemblage of claim 9 wherein said support of said photosensitive element is opaque, and said image-receiving layer is located on a separate transparent support superposed on the layer outermost from said opaque support.

20. The assemblage of claim 19 wherein said transparent support has thereon, in sequence, a neutralizing layer, a timing layer and said image-receiving layer.

21. The assemblage of claim 19 wherein said opaque support has thereon, in sequence, a neutralizing layer, a timing layer and said silver halide emulsion layer.

22. In an integral photographic assemblage comprising:

(a) a photosensitive element comprising a transparent support having thereon the following layers in sequence: a dye image-receiving layer; an alkaline solution-permeable, light-reflective layer; an alkaline solution-permeable, opaque layer; a stripping layer which enables said dye image-receiving layer to be separated, after processing, from the rest of said assemblage; a cyan dye image-providing material layer, a red-sensitive silver halide emulsion layer; a magenta dye image-providing material layer, a green-sensitive silver halide emulsion layer; a yellow dye image-providing material layer, and a blue-sensitive, silver halide emulsion layer, (b) a transparent cover sheet superposed over said blue-sensitive silver halide emulsion layer and comprising a transparent support having thereon, in sequence, a neutralizing layer and a timing layer; and (c) a rupturable container containing an alkaline processing composition and an opacifying agent, said container being so positioned during processing of said assemblage that a compressive force applied to said container will effect a discharge of the container's contents between said transparent cover sheet and said blue-sensitive silver halide emulsion layer;

the improvement wherein said yellow dye image-providing material layer contains titanium dioxide, which is present at a concentration of from about 0.1 to about 0.75 gram per square meter of coated element.

* * * * *